United States Patent [19]

Kondur, Jr.

[11] 4,015,699

[45] Apr. 5, 1977

[54] ALPHANUMERIC SERIAL PRINTER WITH A FLEXIBLE MEMBRANE PRINTING ELEMENT

[75] Inventor: Nicholas Kondur, Jr., Riverton, Wyo.

[73] Assignee: Burroughs Corporation, Detroit, Mich.

[22] Filed: Oct. 16, 1975

[21] Appl. No.: 622,900

Related U.S. Application Data

[63] Continuation-in-part of Ser. No. 459,020, April 8, 1974, abandoned.

[52] U.S. Cl. ..... 197/57; 178/33 R; 101/109

[51] Int. Cl.[2] ..... B41J 1/16

[58] Field of Search ..... 197/56, 57, 58, 1 R, 197/49, 53; 101/109; 178/33 R, 34

[56] References Cited

UNITED STATES PATENTS

| | | | |
|---|---|---|---|
| 238,387 | 3/1881 | Hall | 197/57 |
| 355,703 | 1/1887 | Morris | 197/57 |
| 421,536 | 2/1890 | Wilcox | 197/57 |
| 1,515,663 | 11/1924 | Dietrich | 197/56 |
| 2,367,313 | 1/1945 | Reynolds et al. | 197/57 X |
| 3,133,497 | 5/1964 | Martin | 197/57 X |
| 3,228,510 | 1/1966 | Howard | 197/49 |
| 3,666,069 | 5/1972 | Suzuki | 178/33 R X |
| 3,696,204 | 10/1972 | Wallskon | 197/49 X |
| 3,838,765 | 10/1974 | Deproux | 197/53 |

*Primary Examiner*—Edward M. Coven
*Attorney, Agent, or Firm*—Robert C. J. Tuttle; Edwin W. Uren; Kevin R. Peterson

[57] ABSTRACT

A serial printer is provided with a multi-position flexible membrane printing element with columns and rows of print characters disposed coplanarly in spaced apart relationship therein, the flexible printing element being differentially positionable along an X and a Y axis to bring selected print characters into printing alignment with an actuatable hammer, the differential positioning of the printing element being effectuated by a rotatable crank and quadrilateral linkage means in association with a pair of position sectors and a pair of spur gears coupled to the quadrilateral linkage, the pair of position sectors being variably positionable by a first and second plurality of actuatable sector limit stops.

32 Claims, 10 Drawing Figures

FIG.1.
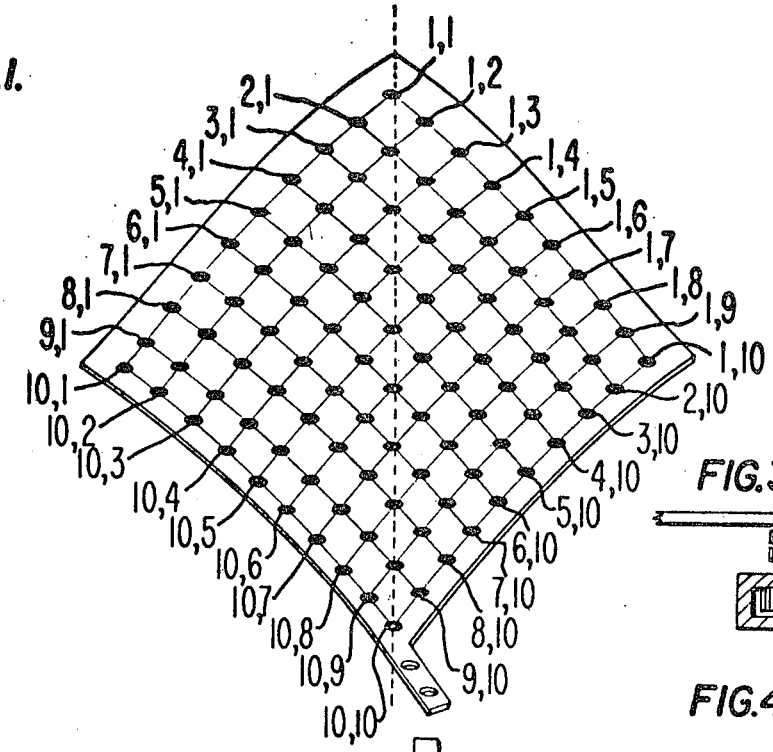
FIG.3.
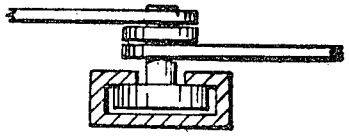
FIG.4.
FIG.5.
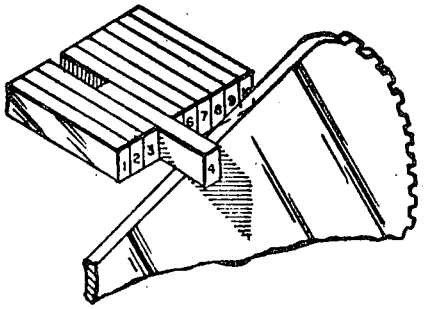
FIG.2.
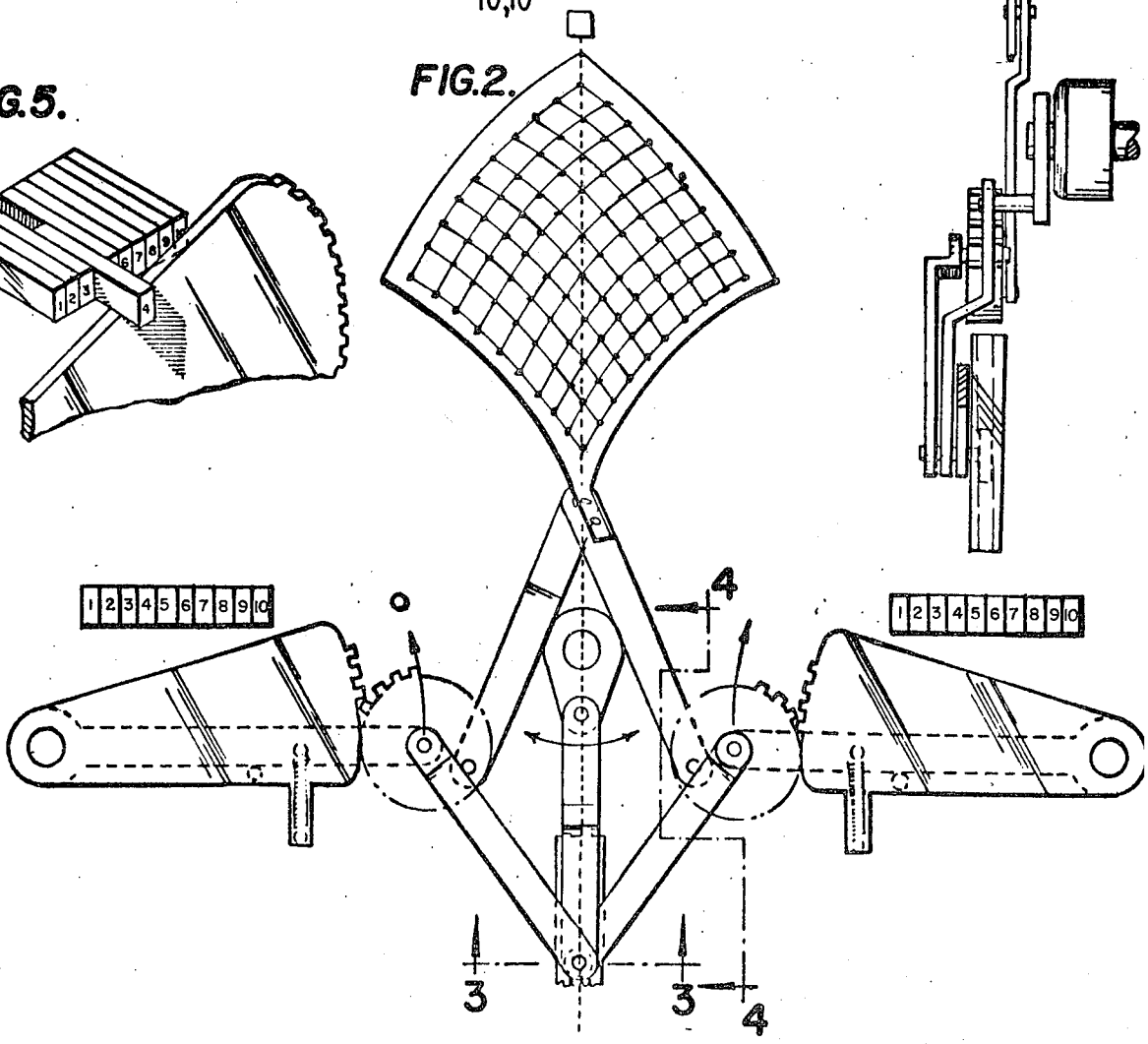

ALPHANUMERIC SERIAL PRINTER WITH A FLEXIBLE MEMBRANE PRINTING ELEMENT

RELATED APPLICATIONS

This application is a continuation-in-part of application Ser. No. 459,020, filed on Apr. 8, 1974 by the present inventors, now abandoned.

BACKGROUND OF THE INVENTION

The term serial printer is generally applied to printing devices that print one character at a time in linear arrangement on a paper medium, the linear arrangement of the printed characters being effectuated by moving an actuatable printing element relative to the paper medium, or by moving the paper medium relative to the printing element.

Known serial printers have commonly provided an impactable hammer that is disposed in cooperating relationship with a differentially positionable and divergently formed printing element, the printing element varying in configuration as between a type bar or stick, a type sector or wheel, a type ball or sphere, and a cylindrical drum along the peripheral surface of which the hammer is transversely activated. Although these known types of serial printers have proven effective in satisfying the requirements of particular and isolated printing tasks, none has succeeded in fully overcoming all of the limitations that have been experienced with serial printers as a class, such limitations including excessive manufacturing cost, relative slowness in printing speed, and insufficiency in the size of the character set that may be arranged on conventional printing elements, be they type bars, wheels, or print balls. Specifically, serial printers equipped with single type bars, sectors or wheels have proven ineffective for use as an alphanumeric serial printer, due to the limited number of type characters that can be arranged on such single printing elements. Serial printers equipped with print balls, on the other hand, although commonly providing a minimal character set suitable for alphanumeric printing, have generally proven to be inefficient from the standpoint of the printing speeds that are attainable thereby, due to the requirement that such balls be both rotatably and tiltably activated during each printing cycle. Serial printers providing a transversely movable hammer and a rotating drum have additionally proven to be exceedingly costly to manufacture, due primarily to the cost of building the print drum.

SUMMARY OF THE INVENTION

It is accordingly an object of the present invention to provide a serial printer that is optimally qualified to satisfy the requirements of alphanumeric printing, and wherein a significant increase in the size of the character set is afforded.

It is another object of the present invention to provide an improved alphanumeric serial printer that is economical to manufacture and to maintain, such economy accruing through the simplistic structure and configuration of the printing element, and the simplicity of the means employed for effectuating its selective positioning.

It is still a further object of the present invention to provide an alphanumeric serial printer wherein accelerated printing speeds may be achieved, such increased speeds being realized by the employment of quick-response actuating and positioning means.

An important aspect of the present invention is the use of a substantially diamond-shaped flexible printing element having a significant plurality of type characters coplanarly arranged in columns and rows therein, the selective positioning of individual type characters being accomplished by the concurrent movement of the printing element along both a Y and an X axis.

Another important aspect of the invention is the use of crank means in association with quadrilateral linkage means and first and second selectively activatable positioning means for differentially moving the printing element along said Y and X axes to thereby select the columns and rows of the printing element in which the selected type characters are located.

BRIEF DESCRIPTION OF THE DRAWING

These and other objects, aspects and advantages of the invention will become apparent from the following description when read in conjunction with the accompanying drawing figures, in which:

FIG. 1 is a front view of the flexible multi-position printing element of the invention wherein the peripheral type character positions are identified in terms of their column and row numbers;

FIG. 2 is a diagrammatic elevational view of the various components of the improved alphanumeric serial printer;

FIG. 3 is a view taken along the line 3—3 of FIG. 2 and showing in particular guide means associated with the quadrilateral linkage means;

FIG. 4 is a view taken along the line 4—4 of FIG. 2 and showing the relationship of the crank means to various components of the quadrilateral linkage means;

FIG. 5 is a perspective view of the left or first plurality of limit stops in association with the left or first position sector, individual limit stops being shown in both a blocking and cleared relationship therewith;

DESCRIPTION OF THE PREFERRED EMBODIMENT

Figure 6:
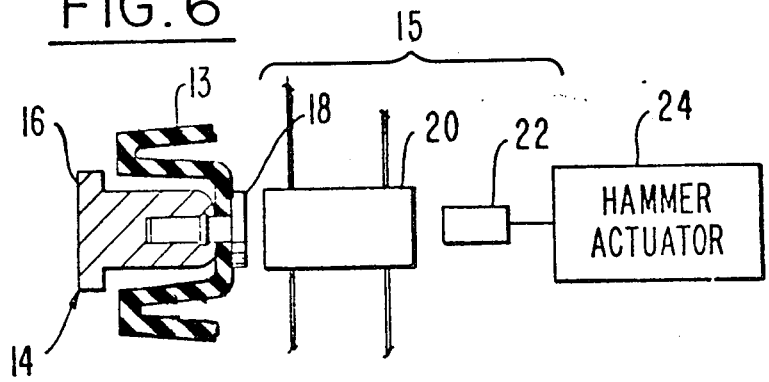
FIG. 6 is an exaggerated diagrammatic view illustrating a representative arrangement for supportably attaching the type characters to the flexible printing element, and illustrating also the relationship of a positioned type character and a hammer and hammer actuator.
Figure 8:
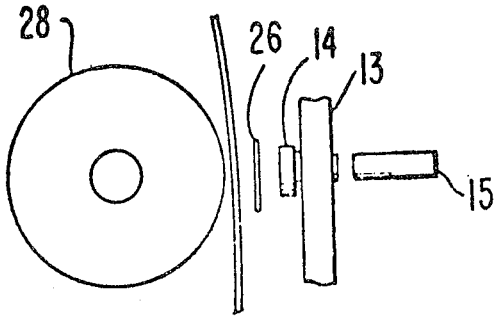
FIG. 8 is a diagrammatic view illustrating the relationship of the flexible printing element and the various other elements that are required for the performance of the printing function.

As best illustrated in FIG. 1, the flexible printing element generally designated at 11 is comprised of a membrane-like base member 13 of substantially diamond shaped configuration, such base member presenting a plurality of 100 equally spaced apart character-retaining apertures each representing a selectable character position. These character positions are arranged in columns and rows of the base member 13, such that each position may be identified in terms of the column and row in which it is located, as suggested by the position identifying numbers set forth in FIG. 1. Each of the character positions of the printing element 11, as represented by a corresponding aperture formed therein, is provided with a type slug such as that illustrated at 14 in FIG. 6, said type slug including a type carrying surface 16 on the extremity thereof adjacent an inked ribbon 26 (FIG. 8) and a paper supporting platen 28, and an oppositely disposed impacting surface 18 against which a single hammer 15 may be brought into impactable contact. The hammer 15 may include a resiliently supported interposer 20 and a striking element 22 that are activatable by any suitable actuating means represented by the block 24 in FIG. 6. The base member 13 may be constructed of any suitable semi-flexible and durable material such as polyurethane, and the type slugs 14 may be of two-piece snap-together construction (as illustrated in FIG. 6) and formed of a suitable phenolic material. The type slugs 14 may additionally be permitted a minimal end play within the apertures in the base member 13, in order to reduce the amount of force transmitted to the base member upon impacting of the hammer 15 against the impacting surfaces 18 of the type slugs. As also illustrated in FIG. 1, the flexible printing element 11 is provided with means such as an angular projection 17 for securably attaching the printing element to hereinafter described quadrilateral linkage means, the illustrated attachment being effectuated by means of a pair of screws and screw holes designated at 19. Although preferably of semi-flexible construction, to provide the necessary damping resiliency when printing selectively positioned type characters, it is to be understood that the printing element 11, the hereinafter described quadrilateral linkage means, and the attachment of the printing element thereto, should combine to rigidly support the printing element and the type slugs thereof in an operative position between the hammer 15 and linked ribbon 26 as illustrated in FIG. 8.

The above described flexible printing element 11, and particularly the projection 17 thereof, is attached to quadrilateral linkage means generally designated at 21 in FIG. 2 and comprised of a pair of terminal links 23 and 25, and a pair of drive links 27 and 29. The terminal links 23 and 25 are pivotally connected together by a pin 31, and the drive links 27 and 29 are pivotally connected by a pin 33 having an enlarged head portion 35 (FIG. 3) the function of which will be hereinafter described. The terminal link 23 and drive link 27 are coupled together by means of a first spur gear 37, and the terminal link 25 and drive link 29 are coupled by a second spur gear 39. It is to be noted that whereas the drive links 27 and 29 are pivotally connected to the axes of the spur gears 37 and 39, respectively, by means of mounting pins 41, the terminal links 23 and 25 are pivotally and radially connected to the spur gears 37 and 39, on the side thereof opposite the side to which the drive links 27 and 29 are pivotally connected, such pivotal and radial connection being effectuated by a pair of pivot pins 43. In order that the terminal links 23 and 25 and the drive links 27 and 29 may function in a scissors-like manner, while at the same time being coplanarly connected to the spur gears 37 and 39, the terminal link 23 is provided with an offset as indicated at 45, and the drive link 27 is provided with an offset as indicated at 47.

Figure 10:
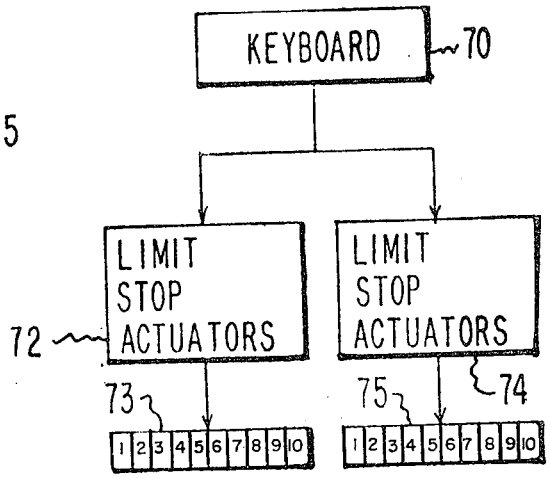
FIG. 10 is a diagrammatic view of representative keyboard input and control means for activating the left and right pluralities of limit stops into blocking relationship to the left and right position sectors.

It is to be noted that the spur gears 37 and 39 are mountably carried by a pair of positioning links 49 and 51, respectively, such links being pivotally mounted on stationary shaft members 53 and 55 of the frame structure of the printing device. The mounting pin 41 connecting the drive link 27 and the spur gear 37 is accordingly also utilized for rotatably mounting the spur gear 37 on the innermost extremity of the positioning link 49. The mounting pin 41 connecting the drive link 29 and the spur gear 39 is likewise utilized for rotatably mounting the spur gear 39 on the innermost extremity of the positioning link 51. Also mounted on the stationary shaft members 53 and 55 are first and second position sectors 57 and 59, respectively. Each of the position sectors 57 and 59 is yieldably connected to its associated positioning link by means of a spring 61, one end of the spring being connected to the positioning link by an anchor pin 63, and the other end of the spring being connected to the position sector by an anchor pin 65 fixed to an extending arm 67 of the position sector. The position sectors 57 and 59 are provided on the innermost edges thereof with exterior teeth 69 which cooperate with the teeth of the spur gears 37 and 39, respectively, in a manner hereinafter described. It is also to be noted that when the positioning links 49 and 51 are positioned in their home positions, as illustrated in FIG. 2, the position sectors 57 and 59 are prevented from rocking upwardly by the contact of a pair of limit pins 71 disposed on the inside surfaces of the position sectors against the lower surfaces of the positioning links 49 and 51. Associated with the first position sector 57 is a first plurality of ten limit stops 73, and associated with the second position sector 59 is a second plurality of limit stops 75. The limit stops 73 and 75 may be individually activated from a normal retracted position illustrated at 77 in FIG. 5, to an activated blocking position illustrated at 79, in any suitable manner such as by actuating means responsive to keyboard input, as illustrated in FIG. 10. In FIG. 10, an electronic keyboard 70 may be provided with an operating key for activating a drive shaft 83, and with 100 character selecting keys for indexing the 100 character positions of the printing element 11 described supra. Limit stop actuators 72 and 74 associated with the left limit stops 73 and the right limit stops 75, respectively, may each be comprised of ten energizable magnets to solenoids which upon energization by depression of corresponding keys of the keyboard 70 will extend selected limit stops 73 and 75 into blocking relationship with the position sectors 57 and 59. Although the particular arrangement of the keyboard and actuating means is not considered to form a part of the present invention, the details of such arrangement would be obvious to those skilled in the art, and especially so in view of the guidance afforded by the Table of Character Positions and Stops set forth infra. It will be observed from FIG. 5 that an individually selected and activated limit stop, such as the limit stop identified by the number 4 in FIG. 5, will serve to blockably limit the upward rocking movement of its associated position sector 57 or 59, such blocking effect being critical to the hereinafter described selective positioning of the individual type slugs arranged in columns and rows in the flexible printing element 11.

The previously described quadrilateral linkage means 21 is operatively connected to crank means generally designated at 81 by a connecting link 82, the crank means including the rotatable drive shaft 83, a one revolution clutch 85, and a crank member 87, the mode of activating the drive shaft 83 and the one revolution clutch 85 not forming a part of the present invention. It will be observed from FIGS. 2 and 4 that the connecting link 82 is offset at 89 to permit pivotal attachment to the pin 33 intermediate the drive links 27 and 29, and to permit pivotal coupling with the crank member 87 by means of an elongated pin 91. The lowermost extremities of the drive links 27 and 29, and of the connecting link 82 are vertically guided in their operative response to each complete revolution of the crank member 87 by means of a channel-like guide 93, the head portion 35 of the pin 33 connecting said links being guidably housed within the channel of the guide 93 as best illustrated in FIG. 3.

OPERATION

To best describe the operation of the inventive alphanumeric serial printer, a general explanation will first be given without any reference to the selective activation of particular limit stops 73 or 75, followed by an explanation of individual operations involving the activation of particular limit stops. During the first 180° revolution of the crank member 87 (in either direction) the connecting link 82 will serve to displace the quadrilateral linkage means 21 such that the angle between the drive links 27 and 29 is increased, displacement of the drive links 27 and 29 being effective to pivot the positioning links 49 and 51 in an upward and outward direction on the shaft members 53 and 55 until limited by a constant position pin 95. This pivoting action of the positioning links 49 and 51 is accomplished by corresponding pivotal movement of the position sectors 57 and 59, as motivated by the springs 61 following the removal of the limiting effect of the positioning links against the limit pins 71. This pivotal movement of the position sectors 57 and 59 will continue until the upper surfaces thereof are limited by activated ones of the limit stops 73 and 75. It is to be noted that during the initial displacement of the drive links 27, 29, and prior to any limiting effect of the activated limit stops 73 and 75 on position sectors 57 and 59 and during the full displacement of the links 27 and 29 when no limit stops 73 and 75 are activated, the positioning links 49 and 51 and the position sectors 57 and 59 will pivot upwardly and outwardly in unison, with the limit pins 71 held in contacting relationship with the lower surface of the positioning links 49 and 51, such movement not being accompanied by any differential rotation of the spur gears 37 and 39 relative to the teeth 69 of the position sectors. The terminal links 23 and 25 of the quadrilateral linkage means 21 will accordingly, in the absence of any differential rotation of the spur gears 37 and 39 relative to the teeth 69, be displaced in such manner as to increase the angle therebetween without moving the printing element 11 upwardly alongs its Y or laterally along its X axis. When, however, during the displacement of the drive links 27 and 29, the position sectors 57 and 59 are limited by activated one of the limit stops 73 and 75, ensuing displacement of the drive links 27 and 29 will be accompanied by the differential walking rotation of the spur gears 37 and 39 relative to the teeth 69 of the position sectors, to thereby move the printing element 11 upwardly along its Y axis and laterally along its X axis, such movements resulting from an effective differential lengthening of the terminal links 23 and 25. The differential walking rotation of the spur gear 37 serves to effectively lengthen the terminal link 23 and to thereby selectively position the printing element 11 along its Y axis, and the differential walking rotation of the spur gear 39 serves to effectively lengthen the terminal link 25 and to thereby selectively position the printing element 11 along its X axis, such axes being identified in FIG. 2. It can thus be seen that by selectively activating one each of the limit stops 73 and 75, as by means of an alphanumeric keyboard of the printing device, the type slugs 14 positioned in the various columns and rows of the printing element 11 may be selectively positioned in printing position, which is to say selectively positioned in impact-receiving relationship relative to the hammer 15 shown at the apex of the printing element 11 in FIG. 2. Following the printing of the selectively positioned type character, which occurs at the approximate 180° point in the rotation of the crank member 87, continued rotation of the crank member will serve to restorably lower the connecting link 82 and to restorably pivot the positioning links 49 and 51 in a downward and inward direction. During the initial pivotal restoration of the positioning links 49 and 51, away from the constant position pin 95, and while the position sectors 57 and 59 are held in limited relationship with the activated limit stops 73 and 75 by the springs 61, the spur gears 37 and 39 will be walkably and restorably rotated relative to the teeth 69 of the position sectors, to thereby restorably activate the therminal links 23 and 25 relative to the spur gears. Continued restorable movement of the connecting link 82 and the positioning links 49 and 51 will result in the restoration of the position sectors 57 and 59, by means of the driving action of the positioning links against the limit pins 71. Upon completion of the restorable lowering of the connecting link 82, and as the crank member 87 reaches the 360° point in its rotation, the drive links 27 and 29 and the terminal links 23 and 25 will have been restored to their normal home positions, and the position sectors 57 and 59 will have been restored to a position of normal spaced apart relationship relative to the innermost of the limit stops 73 and 75.

The positioning of the type slug 14 disposed in the 1,1 position of the printing element (FIG. 1), may accordingly be printably selected by activating the number 1 limit stops of the pluralities of stops 73 and 75, to thereby accord the terminal link 23 with one unit of lengthening and the terminal link 25 with ten units of lengthening. Upon rotation of the crank member 87 with the number 1 stops activated (in the manner of the number 4 stop illustrated in FIG. 5), the second position sector 59 will first limit against its associated number 1 stop after one unit of idling pivotal movement of its associated positioning link 51, during which one unit of idling movement the spur gear 39 will not rotate relative to the sector teeth 69, and the first position sector 57 will limit against its associated number 1 stop after ten units of movement of its associated positioning link 49, during which ten units of movement the spur gear 37 will not rotate. Continued rotation of the crank member 87 after the position sectors 57 and 59 are limited by their number 1 stops will result in one additional unit of pivotal movement of the positioning link 49 (to be limited by the constant position pin 95) and in nine additional units of pivotal movement of the positioning link 51. The one unit of additional movement of the positioning link 49 will result in a one tooth walking rotation of the spur gear 37 relative to the teeth 69, and a corresponding one unit of upward movement of the printing element 11 along its Y axis, as transmitted by the terminal link 23. The nine units of additional movement of the positioning link 51 will result in a nine tooth walking rotation of the spur gear 39 relative to the teeth 69 of its associated position sector, and a corresponding nine units of lateral movement of the printing element 11 along its X axis, as transmitted by the terminal link 25, the combined movements of the printing element 11 along its Y and X axes serving to position the type slug located in the 1, 1 position in impact-receiving relationship relative to the hammer 15.

Figure 7:
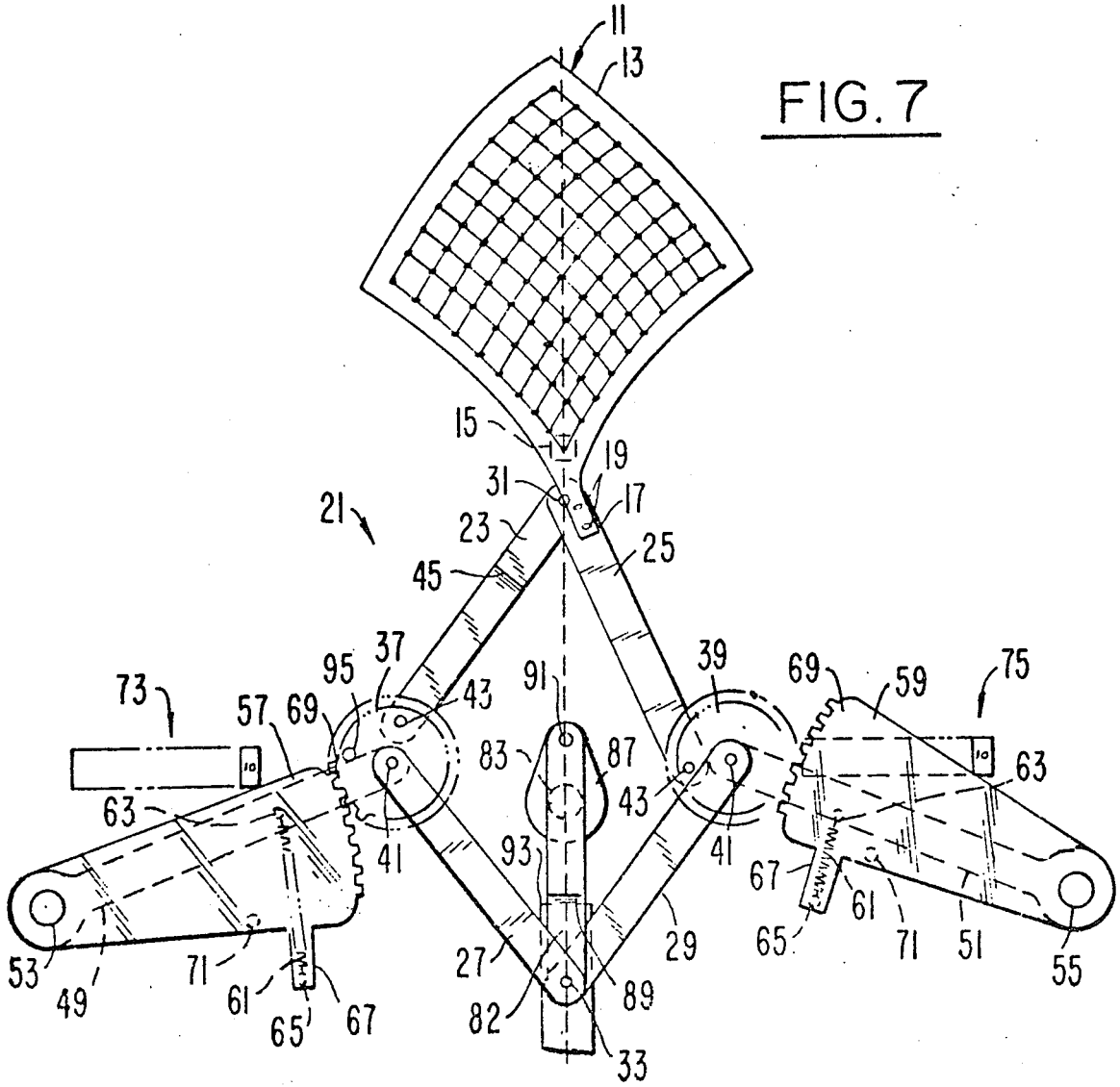
FIG. 7 is an elevational view similar to FIG. 2 and showing the various components in an actuated state effective for printably activating the type character disposed in the 10, 10 position of FIG. 1.

The positioning of the type slug disposed in the 10, 10 position of the printing element 11 may be printably selected by activating the number 10 limit stops of the pluralities 73 and 75, as illustrated in FIG. 7. Upon rotation of the crank member 87 with the number 10 stops activated, the first position sector 57 will first limit against its associated number 10 stop after one unit of rotational movement of its associated positioning link 49, during which movement the spur gear 37 will not rotate, and the second position sector 59 will limit against its associated number 10 stop after ten units of movement of its associated positioning link 51, during which movement the spur gear 39 will not rotate. Continued rotation of the crank member 87 after the position sectors 57 and 59 are limited by their number 10 stops will result in one additional unit of pivotal movement of the positioning link 51, and in nine additional units of pivotal movement of the positioning link 49. The one unit of additional movement of the positioning link 51 will result in a one tooth walking rotation of the spur gear 39 relative to the teeth 69, and a corresponding one unit of lateral movement of the printing element 11 along its X axis, as transmitted by the terminal link 25. The nine units of additional movement of the positioning link 49 will result in a nine tooth walking rotation of the spur gear 37 relative to the teeth 69 of its associated position sector, and a corresponding nine units of upward movement of the printing element 11 along its Y axis, as transmitted by the terminal link 23, the combined movements of the printing element along its Y and X axes serving to position the type slug located in the 10,10 position in impact-receiving relationship relative to the hammer 15, FIG. 7 illustrating the activated positions of the various components when the type slug located in the 10,10 position is disposed in printing alignment relative to the hammer 15.

Figure 9:
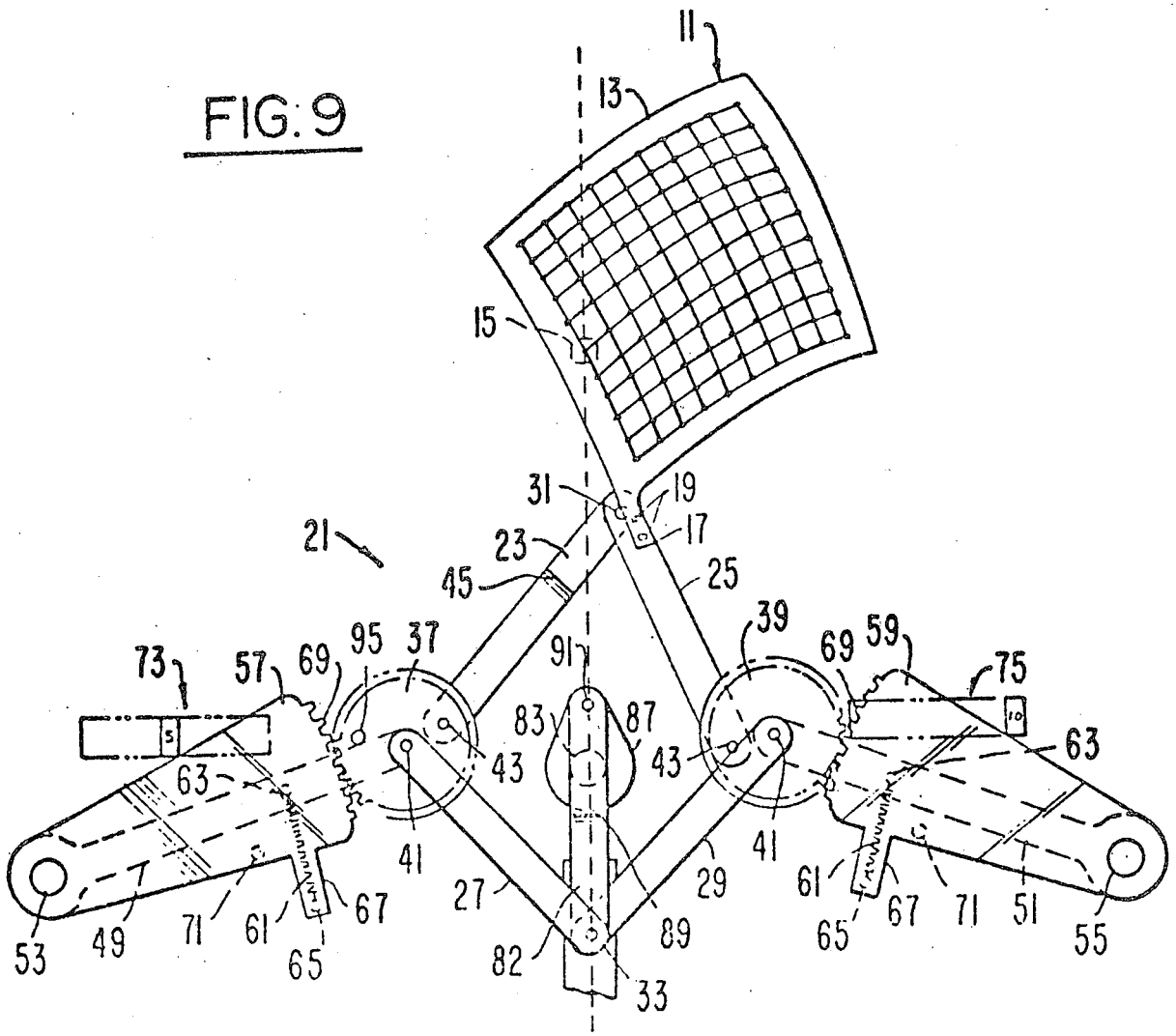
FIG. 9 is an elevational view similar to FIG. 7 and showing the various components in an actuated state effective for printably activating the type character disposed in the 10, 5 position of FIG. 1.

The remaining 98 character positions of the printing element 11 illustrated and partly identified in FIG. 1 may be selectively positioned in impact-receiving relationship relative to the hammer 15 by activating the individual limit stops corresponding thereto as reflected in the following table, FIG. 9 of the drawing illustrating the activated positions of the various components when the type slug 14 located in the 10,5 position is disposed in printing alignment relative to the hammer 15.

TABLE OF PRINTING ELEMENT CHARACTER POSITIONS THAT MAY BE SELECTED BY ACTIVATING SPECIFIED LIMIT STOPS

| Character Position | Stops Activated | | Character Position | Stops Activated | | Character Position | Stops Activated | |
|---|---|---|---|---|---|---|---|---|
| | Left | Right | | Left | Right | | Left | Right |
| 10,10 | 10 | 10 | 2,7 | 7 | 2 | 3,3 | 3 | 3 |
| 9,10 | 10 | 9 | 1,7 | 7 | 1 | 2,3 | 3 | 2 |
| 8,10 | 10 | 8 | 10,6 | 6 | 10 | 1,3 | 3 | 1 |
| 7,10 | 10 | 7 | 9,6 | 6 | 9 | 10,2 | 2 | 10 |
| 6,10 | 10 | 6 | 8,6 | 6 | 8 | 9,2 | 2 | 9 |
| 5,10 | 10 | 5 | 7,6 | 6 | 7 | 8,2 | 2 | 8 |
| 4,10 | 10 | 4 | 6,6 | 6 | 6 | 7,2 | 2 | 7 |
| 3,10 | 10 | 3 | 5,6 | 6 | 5 | 6,2 | 2 | 6 |
| 2,10 | 10 | 2 | 4,6 | 6 | 4 | 5,2 | 2 | 5 |
| 1,10 | 10 | 1 | 3,6 | 6 | 3 | 4,2 | 2 | 4 |
| 10,9 | 9 | 10 | 2,6 | 6 | 2 | 3,2 | 2 | 3 |
| 9,9 | 9 | 9 | 1,6 | 6 | 1 | 2,2 | 2 | 2 |
| 8,9 | 9 | 8 | 10,5 | 5 | 10 | 1,2 | 2 | 1 |
| 7,9 | 9 | 7 | 9,5 | 5 | 9 | 10,1 | 1 | 10 |
| 6,9 | 9 | 6 | 8,5 | 5 | 8 | 9,1 | 1 | 9 |
| 5,9 | 9 | 5 | 7,5 | 5 | 7 | 8,1 | 1 | 8 |
| 4,9 | 9 | 4 | 6,5 | 5 | 6 | 7,1 | 1 | 7 |
| 3,9 | 9 | 3 | 5,5 | 5 | 5 | 6,1 | 1 | 6 |
| 2,9 | 9 | 2 | 4,5 | 5 | 4 | 5,1 | 1 | 5 |
| 1,9 | 9 | 1 | 3,5 | 5 | 3 | 4,1 | 1 | 4 |
| 10,8 | 8 | 10 | 2,5 | 5 | 2 | 3,1 | 1 | 3 |
| 9,8 | 8 | 9 | 1,5 | 5 | 1 | 2,1 | 1 | 2 |
| 8,8 | 8 | 8 | 10,4 | 4 | 10 | 1,1 | 1 | 1 |
| 7,8 | 8 | 7 | 9,4 | 4 | 9 | | | |
| 6,8 | 8 | 6 | 8,4 | 4 | 8 | | | |
| 5,8 | 8 | 5 | 7,4 | 4 | 7 | | | |
| 4,8 | 8 | 4 | 6,4 | 4 | 6 | | | |
| 3,8 | 8 | 3 | 5,4 | 4 | 5 | | | |
| 2,8 | 8 | 2 | 3,4 | 4 | 3 | | | |
| 1,8 | 8 | 1 | 2,4 | 4 | 2 | | | |
| 10,7 | 7 | 10 | 1,4 | 4 | 1 | | | |
| 9,7 | 7 | 9 | 10,3 | 3 | 10 | | | |
| 8,7 | 7 | 8 | 9,3 | 3 | 9 | | | |
| 7,7 | 7 | 7 | 8,3 | 3 | 8 | | | |
| 6,7 | 7 | 6 | 7,3 | 3 | 7 | | | |
| 5,7 | 7 | 5 | 6,3 | 3 | 6 | | | |
| 4,7 | 7 | 4 | 5,3 | 3 | 5 | | | |
| 3,7 | 7 | 3 | 4,3 | 3 | 4 | | | |

While the preferred embodiment of the inventive alphanumeric serial printer has been described herein in considerable detail, it will be understood that various modifications and alterations therein may be conceived by persons skilled in the art without departing from the true spirit and scope of the invention.

What is claimed is:

1. In a printing device including a supporting frame structure having keyboard input means, a rotatable drive shaft, an actuatable hammer, and means for carrying and transversely moving a web medium relative to said hammer, the improvement comprising:

a. rotatable crank means associated with said drive shaft and rotatable therewith in response to said keyboard input means, b. a multi-position printing element operably associated with said hammer and with the web medium carried by said carrying and moving means and having type characters arranged in columns and rows therein, said columns corresponding to a first axis of said printing element and said rows corresponding to a second axis thereof, c. quadrilateral linkage means operably coupled to said crank means and to said printing element and effective in response to said keyboard input means for moving said printing element along its said first and second axes, said linkage means comprising a first and second terminal link connected to said printing element and pivotally coupled together, a first and second drive link pivotally coupled together and coupled also to said crank means, a rotatably mounted first spur gear pivotally coupled to said first terminal link and to said drive link, and a rotatably mounted second spur gear pivotally coupled to said second terminal link and to said second drive link, d. first positioning means coupled to said linkage means and responsive to said keyboard input means to selectively position said printing element relative to its said first axis, said first spur gear being mounted at the innermost extremity of said first positioning means, and e. second positioning means coupled to said linkage means and responsive to said keyboard input means to selectively position said printing element relative to its said second axis, said second spur gear being mounted at the innermost extremity of said second positioning means, said selective positioning of said printing element relative to said first and second axes occurring concurrently during each rotation of said crank means, whereby individual type characters of said printing element may be selectively positioned relative to said actuatable hammer for serially printing characters on said web medium.

2. The improvement in a printing device defined in claim 1 wherein said printing element is flexible in structure and substantially diamond-shaped in configuration.

3. The improvement in a printing device defined in claim 1 wherein each of the columns and rows of said printing element in which said type characters are arranged is comprised of ten character positions for operatively locating a like number of type characters, a total of 100 character positions and type characters being thereby provided by said printing element.

4. The improvement in a printing device defined in claim 1 wherein said printing element is comprised of a membrane-like base member having a plurality of equally spaced apart apertures formed therein, said apertures serving to operatively support said type characters arranged in said columns and rows.

5. The improvement in a printing device defined in claim 4 wherein said membrane-like base member is constructed of polyurethane.

6. The improvement in a printing device defined in claim 4 wherein said type characters operatively supported in said apertures formed in said membrane-like base member are type slugs formed of a phenolic material.

7. The improvement in a printing device defined in claim 1 wherein the rotatable mounting of said first spur gear is effectuated by a first positioning link rotatably supported by the frame structure of said printing device, and the rotatable mounting of said second spur gear is effectuated by a second positioning link also rotatably supported by the frame structure of the printing device, said first and second spur gears being mounted on pins disposed at the innermost extremities of said first and said second positioning links, respectively.

8. The improvement in a printing device defined in claim 7 wherein said first positioning means comprises:

a. a first position sector rotatably mounted on said frame structure in coaxial and yieldably coupled relationship relative to said first positioning link, said first position sector being provided with a plurality of teeth disposed in cooperating relationship relative to the teeth of said first spur gear, and b. a first plurality of activatable sector limit stops disposed in limitable relationship relative to said first position sector, said plurality corresponding in number to the number of character positions in each column and row of said printing element.

9. The improvement in a printing device defined in claim 7 wherein said second positioning means comprises:

a. a second position sector rotatably mounted on said frame structure in coaxial and yieldably coupled relationship to said second positioning link, said second position sector being provided with a plurality of teeth disposed in cooperating relationship relative to the teeth of said second spur gear, and b. a second plurality of activatable sector limit stops disposed in limitable relationship relative to said second position sector, said plurality corresponding in number to the number of character positions in each column and row of said printing element.

10. The improvement in a printing device defined in claim 1 wherein the pivotal coupling of said first and second spur gears to said first and second terminal links and drive links is such that said drive links are concentrically coupled to said spur gears and said terminal links are eccentrically coupled thereto.

11. The improvement in a printing device defined in claim 1 wherein said connection of said printing element to said first and second terminal links is effectuated by the attachment of a projection of said printing element to said second terminal link at a point thereof proximate said pivotal coupling of said second terminal link and said first terminal link, and said coupling of said first and second drive links to said crank means is effectuated by a connecting link pivotally connected at one end thereof to an elongated pin of said crank means and pivotally connected at the other end to the pivotal coupling between said first and second drive links.

12. In a printing device including a supporting frame structure having keyboard input means and an actuatable hammer and effective for serially printing alphabetic and numeric characters on a record medium, the improvement comprising:

a. rotatable crank means responsive to said keyboard input means, b. a printing element operably associated with said hammer and said record medium and having a plurality of type characters arranged in columns and rows thereon in coplanar relationship, c. linkage means operably coupled to said crank means and to said printing element, said linkage means comprising a first and second terminal link connected to said printing element and pivotally coupled together, a first and second drive link pivotally coupled together and coupled also to said crank means, a rotatably mounted first spur gear pivotally coupled to said first terminal link and to said first drive link, and a rotatably mounted second spur gear pivotally coupled to said second terminal link and to said second drive link, and d. positioning means coupled to said linkage means and responsive to said keyboard input means for selectively positioning said printing element relative to said actuatable hammer such that a type character disposed in a selected column and row thereof is cooperably positioned relative to said hammer to be serially printed thereby.

13. The improvement in a printing device defined in claim 12 said printing element is flexible in structure and substantially diamond-shaped in configuration.

14. The improvement in a printing device defined in claim 12 wherein each of the columns and rows of said printing element in which said characters are arranged is comprised of ten character positions for operatively locating a like number of type characters, a total of 100 character positions and type characters being thereby provided said printing element.

15. The improvement in a printing device defined in claim 12 wherein said printing element is comprised of a membrane-like base member having a plurality of equally spaced apart apertures formed therein, said apertures serving to operatively support said type characters arranged in said columns and rows.

16. The improvement in a printing device defined in claim 15 wherein said membrane-like base member is constructed of polyurethane.

17. The improvement is a printing device defined in claim 15 wherein said type characters operatively supported in said apertures formed in said membrane-like base member are type slugs formed of a phenolic material.

18. The improvement in a printing device defined in claim 12 wherein the rotatable mounting of said first spur gear is effectuated by a first positioning link rotatably supported by the frame structure of said printing device, and the rotatable mounting of said second spur gear is effectuated by a second positioning link also rotatably supported by the frame structure of the printing device, said first and said second spur gears being mounted on pins disposed inward of and adjacent said first and said second positioning links, respectively.

19. The improvement in a printing device defined in claim 18 wherein said positioning means comprises:

a. a first position sector rotatably mounted on said frame structure in coaxial and yieldably coupled relationship to said first positioning link, said first position sector being provided with a plurality of teeth disposed in cooperating relationship with the teeth of said first spur gear, b. a second position sector rotatably mounted on said frame structure in coaxial and yieldably coupled relationship to said second positioning link, said second position sector being provided with a plurality of teeth disposed in cooperating relationship with the teeth of said second spur gear, c. a first plurality of activatable limit stops disposed in limitable relationship with said first position sector, said plurality corresponding in number to the number of character positions in each column and row of said printing element, and d. a second plurality of activatable limit stops disposed in limitable relationship with said second position sector, said plurality likewise corresponding in number to the number of character positions in each column and row of said printing element.

20. The improvement in a printing device defined in claim 12 wherein the pivotal coupling of said first and second spur gears to said first and second terminal links and drive links is such that said drive links are concentrically coupled to said spur gears and said terminal links are eccenrically coupled thereto.

21. The improvement in a printing device defined in claim 12 wherein said connection of said printing element to said first and second terminal links is effectuated by the attachment of a projection of said printing element to said second terminal link at a point thereof proximate said pivotal coupling of said second terminal link and said first terminal link, and said coupling of said first and second drive links to said crank means is effectuated by a connecting link pivotally connected at one end thereof to an elongated pin of said crank means and pivotally connected at the other end to the pivotal coupling between said first and second drive links.

22. An alphabetic and numeric serial printer including a supporting frame structure keyboard input means, a drive shaft, an actuatable hammer, and means for transversely moving said hammer relative to a paper medium, said printer additionally comprising:

a. a crank rotatable by said drive shaft in response to said keyboard input means, b. a printing element operably associated with said hammer and said paper medium and having a plurality of type characters arranged in columns and rows thereon in coplanar relationship, said columns corresponding to a Y axis of said printing element and said rows corresponding to an X axis thereof, and c. positioning means associated with said crank means and with said printing element and responsive to said keyboard input means to selectively and concomitantly activate said printing element along its said Y and X axes to thereby position a selected type character located in a selected column and row of said printing element in impact-receiving relationship with said hammer, whereby said selected type character may be serially printed on said paper medium, said positioning means being comprised of linkage means coupled to said crank, first selective means coupled to said linkage means and responsive to said input means to selectively activate the printing element along said Y axis thereof, and second selective means coupled to said linkage means and responsive to said input means to selectively activate the printing element along said X axis thereof, said linkage means comprising a first and second terminal link connected to said printing element and pivotally coupled together, a first and second drive link pivotally coupled together and coupled also to said crank, a rotatably mounted first spur gear pivotally coupled to said first terminal link and to said first drive link, and a rotatably mounted second spur gear pivotally coupled to said second terminal link and to said second drive link.

23. The serial printer defined in claim 22 wherein said printing element is flexible in structure and substantially diamond-shaped in configuration.

24. The serial printer defined in claim 22 wherein each of the columns and rows of said printing element in which said type characters are arranged is comprised of ten character positions for operatively locating a like number of type characters, a total of 100 character positions and type characters being thereby provided said printing element.

25. The serial printer defined in claim 22 wherein said printing element is comprised of a membrane-like base member having a plurality of equally spaced apart apertures formed therein, said apertures serving to operatively support said type characters arranged in said columns and rows.

26. The serial printer defined in claim 25 wherein said membrane-like base member is constructed of polyurethane.

27. The serial printer defined in claim 25 wherein said type characters operatively supported in said apertures formed in said membrane-like base member are type slugs formed of a phenolic material.

28. The serial printer defined in claim 22 wherein the rotatable mounting of said first spur gear is accommodated by a first positioning link rotatably supported by said frame structure of said printer, and the rotatable mounting of said second spur gear is accommodated by a second positioning link also rotatably supported by said frame structure, said first and second spur gears being mounted on pins inward of and adjacent said first and said second positioning links.

29. The serial printer defined in claim 28 wherein said first selective means of said positioning means comprises:

a. a first position sector rotatably mounted on said frame structure in coaxial and yieldably coupled relationship with said first positioning link, said first position sector being provided with a plurality of teeth disposed in cooperating relationship with the teeth of said first spur gear, and b. a first plurality of activatable limit stops disposed in limitable relationship to said first position sector, said plurality corresponding in number to the number of character positions in each column and row of said printing element.

30. The serial printer defined in claim 28 wherein said second selective means of said positioning means comprises:

a. a second position sector rotatably mounted on said frame structure in coaxial and yieldably coupled relationship with said second positioning link, said second position sector being provided with a plurality of teeth disposed in cooperating relationship with the teeth of said second spur gear, and d. a second plurality of activatable limit stops disposed in limitable relationship with said second position sector, said plurality corresponding in number to the number of character positions in each column and row of said printing element.

31. The serial printer defined in claim 22 wherein the pivotal coupling of said first and second spur gears to said first and second terminal links and drive links is such that said drive links are concentrically coupled to said spur gears and said terminal links are eccentrically coupled thereto.

32. The serial printer defined in claim 22 wherein said connection of said printing element to said first and second terminal links is accommodated by the attachment of a projection of said printing element to said second terminal link at a point thereof proximate said pivotal coupling of said second terminal link and said first terminal link, and said coupling of said first and second drive links to said crank is accommodated by a connecting link pivotally connected at one end thereof to an elongated pin of said crank and pivotally connected at the other end to the pivotal coupling between said first and second drive links.

* * * * *